US006519208B2

(12) United States Patent
DeVries

(10) Patent No.: US 6,519,208 B2
(45) Date of Patent: Feb. 11, 2003

(54) LOCKING TIMER AND OUTLET COVER

(76) Inventor: Paul DeVries, 13 Brooksyde Ave., Ringwood, NJ (US) 07456

( * ) Notice: Subject to any disclaimer, the term of this patent is extended or adjusted under 35 U.S.C. 154(b) by 94 days.

(21) Appl. No.: 09/737,244

(22) Filed: Dec. 15, 2000

(65) Prior Publication Data

US 2002/0075760 A1 Jun. 20, 2002

(51) Int. Cl.[7] ..... G04B 37/00; G05K 5/03

(52) U.S. Cl. ..... 368/10; 368/283; 307/141.4; 307/141; 174/50; 174/66

(58) Field of Search ..... 368/89, 95, 203, 368/204, 276, 283, 10; 307/141, 141.4, 125; 174/48, 50, 66, 67; 220/3.8, 242, 210

(56) References Cited

U.S. PATENT DOCUMENTS 3,581,029 A * 5/1971 Noiles ..... 307/141
3,833,779 A * 9/1974 Leone ..... 307/141
3,879,332 A * 4/1975 Leone ..... 307/141
4,484,220 A * 11/1984 Beetner ..... 348/730
4,588,901 A * 5/1986 Maclay et al. ..... 307/141
4,712,019 A * 12/1987 Nilssen ..... 307/141
5,125,492 A * 6/1992 Traleaven et al. ..... 307/141
5,191,231 A * 3/1993 Berry ..... 307/141
5,243,135 A * 9/1993 Shotey ..... 220/210
5,245,507 A * 9/1993 Erickson ..... 174/67
5,283,475 A * 2/1994 Berger ..... 307/141
5,317,108 A * 5/1994 Prairie, Jr. ..... 174/67
5,434,368 A * 7/1995 Hoffman ..... 200/43.22
5,533,637 A * 7/1996 Williams, Jr. ..... 220/3.8
6,028,268 A * 2/2000 Stark et al. ..... 220/242

* cited by examiner

*Primary Examiner*—Vit Miska
*Assistant Examiner*—Jeanne-Marguerite Goodwin
(74) *Attorney, Agent, or Firm*—Bernhard P. Molldrem, Jr.

(57) ABSTRACT

A locking timer assembly for controlling access time for a television, video game, or computer, employs a lockable enclosure box that attaches onto a wall outlet in place of the usual face plate. The volume inside the box encloses a standard 24-hour on-off timer. The box attaches to the outlet by the usual single screw. The cordset for the controlled device plugs into the timer, and then the cord exits the enclosure via a passage, such as a slit, but the slit does not permit passage of the plug. As an added safety feature, there can be a quick-disconnect plunger so that the timer device can be forced out (e.g., by wedge action) from the associated wall outlet. The plunger has a head portion extending outside the enclosure, and can be pushed in using the fingers. Once this is done, the timer cannot be plugged back in until the enclosure is unlocked and opened.

7 Claims, 3 Drawing Sheets

LOCKING TIMER AND OUTLET COVER

BACKGROUND OF THE INVENTION

This invention relates to devices for controlling access to electrical appliances or equipment, such as televisions, computers, or other devices, by controlling the times that power is available to it.

Household electrical devices such as televisions are often the subject of parental control, that is, parents desire some means to control access by their children. For example, if parent wants to leave their children in the care of a sitter, the parent may want to limit the children's television viewing to programming between certain times. At the present time this usually involves having to rely on the sitter to enforce the viewing hours. As another example, a home office may contain a computer, copier, or other equipment that is to be used only during business hours, i.e., only between 8:00 AM and 6:00 PM, and the owner may not want others to use the equipment without authorization after hours. Some equipment of this type may be programmable to be inoperative during certain hours, and some other equipment may contain a built in lockable timer. However, in either case, the equipment was especially designed with access limitation in mind. It is much more difficult to limit time of availability for equipment that was not designed for limited or restricted use.

Electrical equipment of this type will have a cordset that is permanently attached to it, with a plug at the end of the cordset that plugs into a wall outlet. Simply limiting times that power is available from a particular wall outlet does not prevent someone from unplugging equipment and plugging it into a different wall outlet.

Ideally, the plug end of the cord should be plugged into a timed outlet, and then locked, but no means has been provided for doing this.

OBJECTS AND SUMMARY OF THE INVENTION

Accordingly, it is an object of this invention to provide a locking timer that can be used with an electrical device to control access.

It is a more specific object to provide a locking timer in which a lockable enclosure, e.g., of plastic, metal or other material, is attached onto a wall outlet in place of the usual face plate, and encloses a standard 24-hour grounded on-off timer (the invention is not limited to grounded timers). The box attaches to the outlet by the usual threaded member, which may be a single screw. For the typical wall outlet there are openings provided for the two receptacles of the outlet. The cordset for the television or other controlled device plugs into the timer, and then the cord exits the enclosure via a passage, such as a slit. The slit does not permit passage of the plug. The box or enclosure has a large enough internal volume to accommodate the height, width, and depth of the standard timer device. The volume also accommodates the cordset plug, which typically plugs into an outlet on one side of the timer device.

As an added safety feature, there can be a quick-disconnect plunger so that the timer device can be forced out (e.g., by wedge action) from the associated wall outlet. The plunger has a head portion extending outside the enclosure, and can be pushed in using the fingers. Once this is done, the timer cannot be plugged back in until the enclosure is unlocked and opened.

The above and many other objects, features, and advantages of this invention will become apparent to persons skilled in the art from the ensuing description of a preferred embodiment, which is to be read in conjunction with the accompanying Drawing.

DETAILED DESCRIPTION OF THE PREFERRED EMBODIMENT

Figure 1:
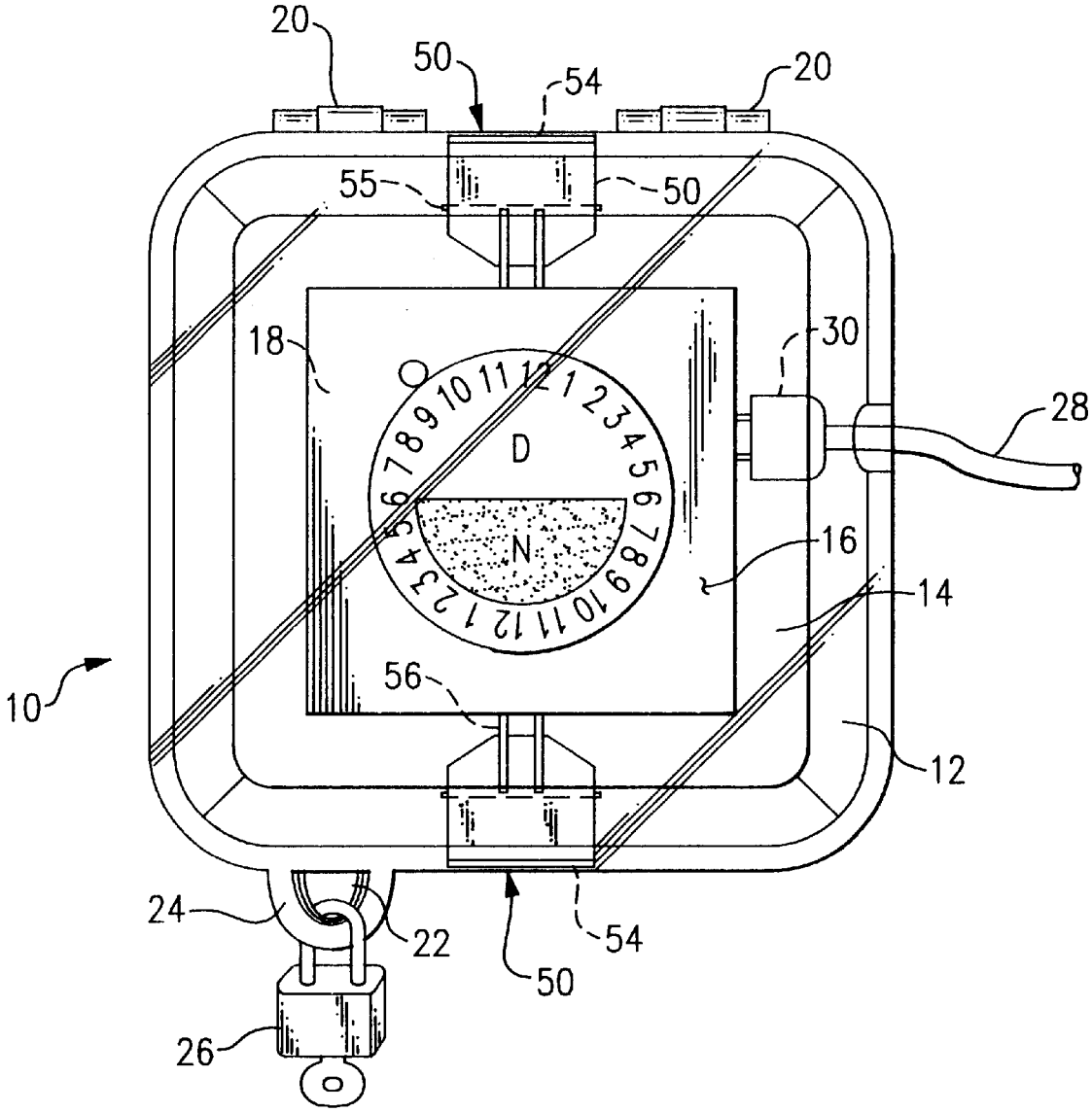
FIG. 1 is a front elevation of a combination lockable outlet cover and 24-hour timer, according to one possible embodiment of this invention.

With reference to the Drawing, and initially to FIG. 1, a receptacle cover box or enclosure 10 is provided as one possible embodiment of the invention. The cover box 10 is lockable, and has a back outlet cover plate member 12 that fits onto a standard wall outlet, as well as a front cover 14 that is hingedly attached to it to permit the cover box to open and close. In this case, the front cover 14 has a clear plastic front wall 16, which shows a 24-hour timer switch 18 within the volume inside the box or enclosure 10. The timer switch 18 shown here is of an analog type, that is with a twist-type timer dial, but there are many equivalent timers that could be used, including digital units. This timer switch 18 can be a standard, generally-available, off-the-shelf device. Typically, these permit three on-off settings per twenty-four hour period. In this embodiment a pair of hinges 20 is located at the top edges of the back outlet cover plate member 12 and the front plate 14, with hinge halves on each. There are many other designs of boxes of this type that could be used, with other hinge designs and with the hinge or pivot mechanism located elsewhere. At a comer away from the hinges 20 are an eye or loop member 22 on the back cover plate member 12 and a matching eye or loop member 24 on the front cover member 14. These loop members 22 and 24 align with each other when the box 10 is closed to receive a suitable lock or seal member. In this case a small padlock 26 is shown, with a key. However, it is sufficient for the receptacle cover box to be tamper-evident, and a suitable tape or wire seal or closure may be used to seal the enclosure 10, which could not be removed and then re-installed or replaced without an indication of tampering.

An appliance cord set 28 is shown here in part, which extends to a television set or other electrical appliance (not shown), such as a computer, video game, etc., and which has a male plug 30 that fits into a grounded receptacle at one side of the timer switch 18.

Figure 2:
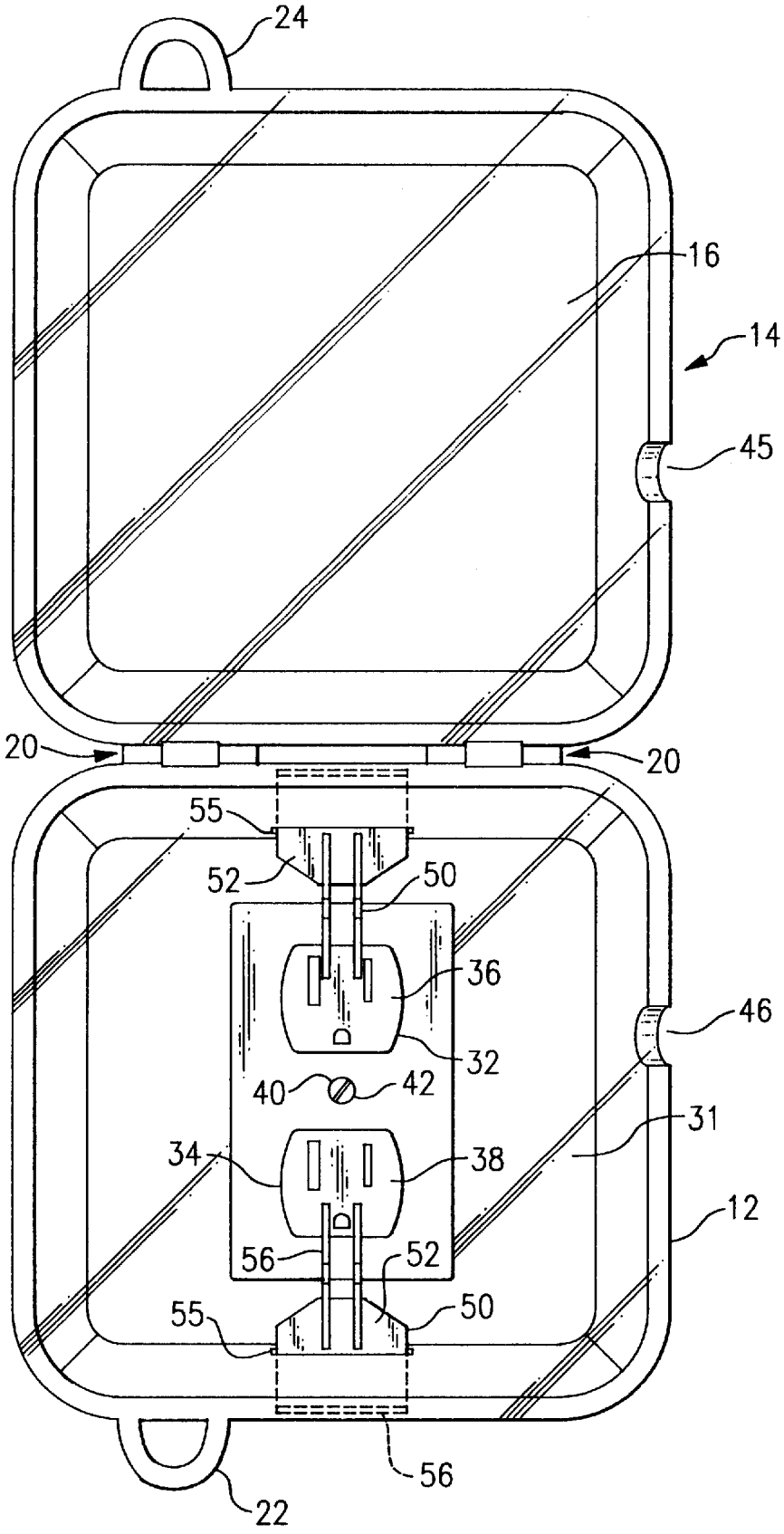
FIG. 2 is another elevation showing the outlet cover box in an open position.

As shown better in FIG. 2, the back outlet cover plate member 12 has a back plate portion 31 that is dimensioned to fit onto and attach to a standard wall outlet. Here the back plate portion 31 has an upper receptacle opening 32 and a lower receptacle opening 34, which receive an upper wall outlet receptacle 36 and a lower wall outlet receptacle 38, respectively. A screw opening 40 is provided, here in the usual place between the two receptacle openings 32 and 34, for attaching the member 12 to the wall outlet.

Figure 3:
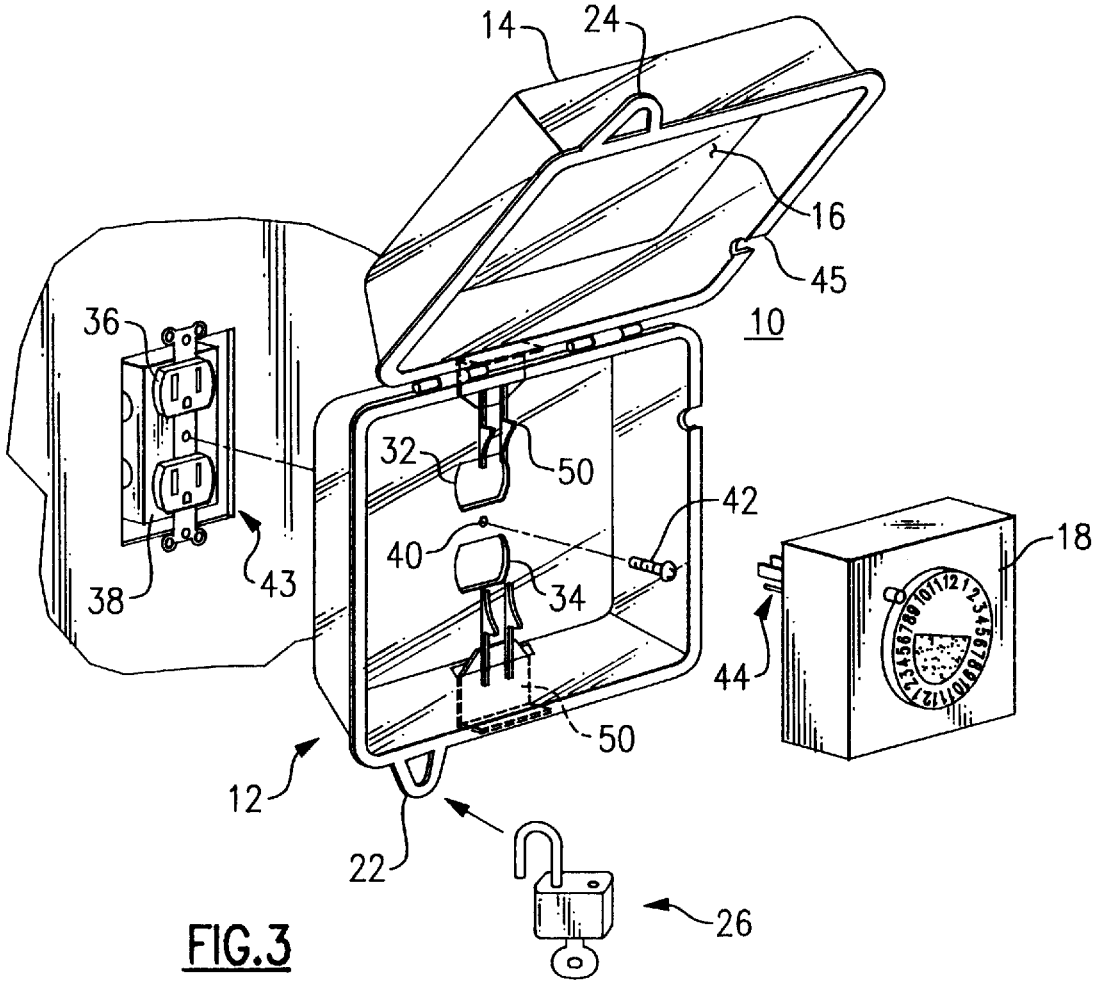
FIG. 3 is a perspective assembly view of this embodiment.

In the assembly view of FIG. 3 a mounting screw 42 is shown for installing through the opening 40 into the wall outlet 43. As shown, the timer switch 18 has metal blades or tangs 44 that fit into corresponding openings in the outlet receptacle 36, and then the front cover member 14 is closed over the timer switch, and the lock 26 (or tamper-evident closure) is installed through the loops 22 and 24. A recess 45 is provided on one side of the front cover 14 and a mating recess 46 is provided at a corresponding position of the back plate member 12. These recesses together form a passage for the cord 28 when the box 10 is closed over the cordset and plug 30. The plug 30 cannot be removed through this passage. Of course, in other designs for the enclosure or box, the passage could be at another side, or at the top or bottom. The slit or other passage can be entirely in the front cover, entirely in the back member, or partly in each.

The responsible adult, e.g., parent, can set the timer and plug in the appliance, and then simply close the box and lock it. The child or baby sitter cannot remove the plug 30 from the locked enclosure, and thus cannot plug the television or other appliance into an uncontrolled outlet. The locked enclosure 10 also denies access to the timer switch selector dial, so the timer switch cannot be adjusted or over-ridden. Any attempt to open the box 10 or to tamper with the timer switch 18 without removing the lock will result in evident damage, which cannot be hidden from the parent or other responsible adult. On the other hand, the responsible adult can easily access the timer switch 18 simply by using the key to open the lock 26.

Figure 4:
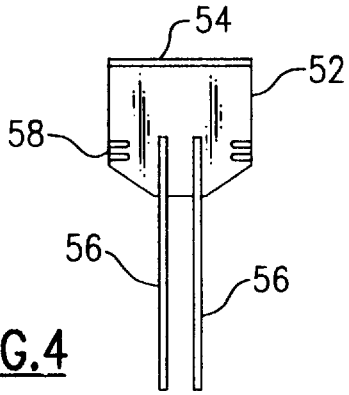
FIGS. 4 and 5 are front and side views of the emergency disconnect plunger employed in this embodiment.
Figure 5:
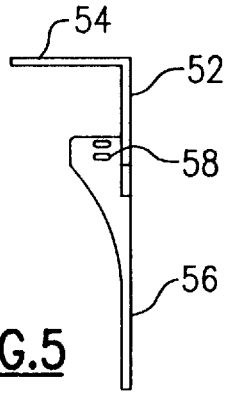

Also shown in the Drawing figures is a pair of quick disconnect plungers 50. In this embodiment, there is a separate plunger 50 for each of the two outlet receptacles, but in other possible embodiments, a single plunger 50 may be provided. As shown in FIGS. 4 and 5, the plunger is formed as a single piece of a tough plastic resin, with a flat plate or head portion 52. There is a flange or foot member 54 at a proximal edge of the head portion, that is, on the side disposed to the outside of the enclosure or box 10. Here, a slot 55 is provided in the back outlet cover plate member 12 to permit limited sliding action for the plunger 50. A blade portion 56 extends to the inward side of the box from the head portion 52, and in this embodiment the blade portion is constituted as a pair of parallel rails, each of which is of a ramp or wedge profile, as seen in FIG. 5. There are bosses or bumps 58 on the plate or head portion 52 to prevent the plunger from being withdrawn through the slot 55.

If there is some reason that the television or other appliance must be unplugged from the outlet, e.g., in case smoke or flame is detected as coming from the appliance, the user disconnects it by simply pushing down on the plunger 50. The rails or blade forces the body of the timer switch 18 away from the outlet receptacle 36, and this pulls the tangs or blades 44 out of the outlet. Once this is done, the timer switch 18 cannot be plugged back in until the box 10 is unlocked and opened.

While a clear plastic cover box 10 has been used here, the box could be made of other designs and other materials, including opaque plastics or metals. The lock mechanism can be disposed elsewhere besides the location shown for the two loops 22 and 24. The receptacle openings 32 and 34 could be of other designs also, to accommodate other standard receptacles, with single receptacle outlets and ground-fault isolation receptacle outlets being two examples. The box should have adequate interior dimensions, i.e., height, width, and depth, to accommodate the height, width, and depth of the body of the timer switch 18, plus the plug 30 of the cordset 28. There are many standard timers available.

Many other modifications and variations are possible which would not depart from the scope and spirit of this invention, as defined in the appended claims.

I claim:

1. A lockable timer assembly that mounts onto an electrical wall outlet for controlling time of access to an electric appliance which includes a cordset having a plug at its end, comprising:

a closable outlet cover enclosure which includes a back outlet cover plate member and a mating front cover member hingedly connected thereto; said back outlet cover plate member having at least one opening therein to permit access to an outlet receptacle of said wall outlet, and at least one screw hole positioned to permit said back outlet cover plate member to receive a screw for mounting onto said wall outlet; corresponding hinge members on said back outlet cover plate member and on said front cover member to permit the back outlet cover plate member and the front cover member to open and close onto one another; lock retaining means in one or both of said front cover member and said back outlet cover plate member to receive a lock device when said front cover member is closed against said back outlet cover plate member and means to permit passage of said cordset between said back outlet cover plate member and said front cover member and preventing withdrawal of the plug from said outlet cover enclosure when said front cover member is closed against said back outlet cover plate member;

a user-settable timer switch device having a housing, electrical tangs that project from a back side of the housing and fit into said outlet receptacle, and an electrical receptacle to receive the plug of the appliance cordset, said timer having a height, width, and breadth; and wherein said back outlet cover plate member and said front cover member together define an interior volume of sufficient height, width, and breadth to accommodate said timer switch device and said plug.

2. A lockable timer assembly according to claim 1 wherein said lock retaining means includes a first eye on said front cover member and a second eye on said back outlet cover plate member.

3. A lockable timer assembly according to claim 2 wherein said first eye and said second eye align with one another when the front cover member is closed onto said back outlet cover plate member.

4. A lockable timer assembly according to claim 1 wherein said front cover member is formed at least in part of a transparent plastic such that said timer switch device is visible through said front cover member.

5. A lockable timer assembly that mounts onto an electrical wall outlet for controlling time of access to an electric appliance which includes a cordset having a plug at its end, comprising:

a closable outlet cover enclosure which includes a back outlet cover plate member and a mating front cover member hingedly connected thereto; said back outlet cover plate member having at least one opening therein to permit access to an outlet receptacle of said wall outlet, and at least one screw hole positioned to permit said back outlet cover plate member to receive a screw for mounting onto said wall outlet; corresponding hinge members on said back outlet cover plate member and on said front cover member to permit the back outlet cover plate member and the front cover member to open and close onto one another; lock retaining means in one or both of said front cover member and said back outlet cover plate member to receive a lock device when said front cover member is closed against said back outlet cover plate member and means to permit passage of said cordset between said back outlet cover plate member and said front cover member and preventing withdrawal of the plug from said outlet cover enclosure when said front cover member is closed against said back outlet cover plate member;

a user-settable timer switch device having electrical tangs that fit into said outlet receptacle, and an electrical receptacle to receive the plug of the appliance cordset, said timer having a height, width, and breadth;

wherein said back outlet cover plate member and said front cover member together define an interior volume of sufficient height, width, and breadth to accommodate said timer switch device and said plug, and an emergency disconnect plunger having a head portion disposed outside said outlet cover enclosure and a blade portion disposed inside said outlet cover enclosure between said back outlet cover plate member and said timer switch device.

6. A lockable timer assembly according to claim 5 wherein said head portion has a flat plate portion fitting through a slot in said back outlet cover plate member.

7. A lockable timer assembly according to claim 5 wherein blade portion includes a pair of rail members extending to said at least one opening in said back outlet cover plate member.

* * * * *

UNITED STATES PATENT AND TRADEMARK OFFICE

CERTIFICATE OF CORRECTION

PATENT NO. : 6,519,208 B2
DATED : February 11, 2003
INVENTOR(S) : Paul DeVries

It is certified that error appears in the above-identified patent and that said Letters Patent is hereby corrected as shown below:

Column 2,
Line 41, "comer" should read -- corner --

Signed and Sealed this

Seventeenth Day of June, 2003

JAMES E. ROGAN
*Director of the United States Patent and Trademark Office*